US008536500B2

(12) United States Patent
Glasson

(10) Patent No.: US 8,536,500 B2
(45) Date of Patent: Sep. 17, 2013

(54) SYSTEM AND METHOD FOR RAPID AIMING AND FIRING OF DEFENSIVE COUNTERMEASURES

(75) Inventor: Richard O. Glasson, Morris Plains, NJ (US)

(73) Assignee: CPI IP, LLC, East Hanover, NJ (US)

( * ) Notice: Subject to any disclaimer, the term of this patent is extended or adjusted under 35 U.S.C. 154(b) by 1097 days.

(21) Appl. No.: 12/187,842

(22) Filed: Aug. 7, 2008

(65) Prior Publication Data

US 2012/0210851 A1 Aug. 23, 2012

(51) Int. Cl.

| | |
|---|---|
| ***F41F 3/04*** | (2006.01) |
| ***F41F 7/00*** | (2006.01) |
| ***F41G 9/00*** | (2006.01) |
| *F41F 3/00* | (2006.01) |

(52) U.S. Cl.

USPC ..... 244/3.1; 89/1.8; 89/1.816; 89/1.11; 89/1.1

(58) Field of Classification Search

USPC ..... 89/1.11, 1.1, 1.8–1.808, 1.813–1.819, 89/1.51, 1.54; 244/3.1; 342/13, 61–67, 118, 342/146, 147; 102/382, 383, 393, 473, 489, 102/499, 500

See application file for complete search history.

(56) References Cited

U.S. PATENT DOCUMENTS

| | | | | |
|---|---|---|---|---|
| 2,876,678 | A * | 3/1959 | Lyon | 89/1.804 |
| 3,018,692 | A * | 1/1962 | Bilek | 89/1.815 |
| 3,172,330 | A * | 3/1965 | Lidmalm et al. | 89/1.817 |
| 3,173,334 | A * | 3/1965 | Landstrom | 89/1.802 |
| 3,228,295 | A * | 1/1966 | Kane et al. | 89/1.802 |
| 3,245,317 | A * | 4/1966 | Matson et al. | 89/1.8 |
| 3,249,011 | A * | 5/1966 | Wermager et al. | 89/1.8 |
| 3,263,565 | A * | 8/1966 | Dragonetti et al. | 89/1.804 |
| 3,412,640 | A * | 11/1968 | Nash | 89/1.806 |
| 3,865,009 | A * | 2/1975 | Kongelbeck | 89/1.815 |
| 3,938,439 | A * | 2/1976 | Walton | 102/393 |
| 4,040,334 | A * | 8/1977 | Smethers, Jr. | 89/1.804 |
| 4,063,485 | A * | 12/1977 | Carter et al. | 89/1.816 |
| 4,208,949 | A * | 6/1980 | Boilsen | 89/1.801 |
| 4,305,325 | A * | 12/1981 | Lange et al. | 89/1.815 |
| 4,333,384 | A * | 6/1982 | Arnold | 89/1.803 |
| 4,409,880 | A * | 10/1983 | Fetterly | 89/1.804 |
| 4,475,436 | A * | 10/1984 | Campbell | 89/1.804 |
| 4,681,013 | A * | 7/1987 | Farley et al. | 89/1.815 |
| 4,777,882 | A * | 10/1988 | Dieval | 102/489 |
| 4,960,055 | A * | 10/1990 | Dieval | 102/489 |
| 4,974,515 | A * | 12/1990 | Busch et al. | 102/489 |
| 5,005,481 | A * | 4/1991 | Schneider et al. | 102/393 |
| 5,107,767 | A * | 4/1992 | Schneider et al. | 102/393 |
| 5,129,307 | A * | 7/1992 | Cain et al. | 89/1.815 |
| 5,187,318 | A * | 2/1993 | Sanderson et al. | 89/1.54 |
| 5,452,640 | A * | 9/1995 | Bovee et al. | 89/1.815 |
| 6,138,951 | A * | 10/2000 | Budris et al. | 102/393 |

FOREIGN PATENT DOCUMENTS

FR 2611259 A1 * 8/1988

OTHER PUBLICATIONS

Wikipedia entry for "Vasa" on the Internet at wikipedia.org; accessed on May 13, 2013.*

Dottie E. Mayol, "The Swedish Ship Vasa's Revival"; University of Miami; Miami, Florida, 1996; posted on line at www.abc.se/~pa/publ/vasa.htm. Retrieved on May 13, 2013.*

* cited by examiner

*Primary Examiner* — Bernarr Gregory

(57) ABSTRACT

A system and method for rapid aiming and firing of weapons and defensive countermeasures against rocket-propelled grenades or other ballistic devices suitable for use on aircraft, ground vehicles, and ships.

21 Claims, 6 Drawing Sheets

SYSTEM AND METHOD FOR RAPID AIMING AND FIRING OF DEFENSIVE COUNTERMEASURES

RELATED CASES

The present application is related to U.S. patent application Ser. No. 11/030,649, filed Jan. 6, 2005 and entitled "Rocket Propelled Barrier Defense System," now abandoned, which is a continuation-in-part of U.S. patent application Ser. No. 12/082,237, filed Apr. 9, 2008 and entitled "Rocket Propelled Barrier Defense System," now U.S. Pat. No. 8,122,810, all of which are incorporated herein by reference.

TECHNICAL FIELD

This invention relates generally to defensive systems for use against ballistic threats and missiles. Specifically the invention relates to ultra-rapid aiming and launching of defensive countermeasures including non-fratricidal countermeasures into the flight path of oncoming threats such as ballistic missiles and Rocket-Propelled Grenades (RPGs).

BACKGROUND

The threat posed by small ballistic weapons such as rocket-propelled grenades (RPGs) and shoulder fired missiles is significant and well documented. Attacks are routine and result in substantial losses of lives and equipment. The constant threat of RPG attack is a significant tactical advantage for insurgent forces. Other missile types, such as the Soviet SA series, and shoulder-fired Stinger are serious threats worldwide. Emerging threats such as the so-called "lob bomb" are similar in nature to the RPG and add a new dimension to this problem.

While attacks on vehicles on the ground are most prevalent, aircraft are also frequently targeted. The RAND corporation has published a report entitled "Protecting Commercial Aviation Against the Shoulder-Fired Missile Threat" (J. Chow, et al.), which is incorporated herein by reference, provides a comprehensive survey of existing and future missile threats as well as the existing countermeasures. The report concludes that there is a pressing need for a practical, reliable defense system for use against these threats. The threat is greatest for military aircraft. RPG and other shoulder-fired missile attacks on military aircraft are common, and include attacks on both fixed-wing and VTOL hovering aircraft.

Detecting Threats

Much work has been done on vehicle-mounted systems for the detection and localization of ballistic threats after they have been fired and are traveling toward their prospective target vehicle or aircraft. In general these systems rely on infra-red detectors and/or microwave radar to detect the firing of an RPG or a bullet. The systems generally provide the host vehicle with data on the type of threat and the direction that it was fired from. U.S. Pat. No. 6,980,151 to Mohan, "System and Method for Onboard Detection of Ballistic Threats to Aircraft," describes a radar system and signal processing method for detection of missiles. U.S. Pat. No. 7,046,187 to Fullerton, et al, "System and Method for Active Protection of a Resource," describes the use of an ultrawideband radar for threat detection. Commercially developed threat detection systems, such as Mustang Technologies "Crosshairs" RPG detection countermeasure system and Radiance Technologies "WeaponWatch" system, provide warning and directional data on fired threats. The major objective of these systems is to enable the target vehicle to quickly and accurately return fire in response to an attack. For example, in the case of a sniper attack, the target vehicle could fire back at the precise location that the bullet came from, hopefully preventing additional shots from being fired on the host vehicle. Return fire could be accomplished by, for example, a gun mounted in a turret that is aimed automatically by a system that utilizes the threat directional data provided by the threat warning system. Such a system allows rapid return fire in the case of an attack.

In the case of attack by RPG however, the objective of a defensive system should be to not only return fire, but to fire one or more countermeasures into the pathway of the approaching RPG thus stopping the RPG before it hits the target vehicle. The term "countermeasure" as used herein is broadly construed to reference any type of projectile that is capable of stopping, deflecting, or detonating an RPG or other ballistic missile or projectile before it hits its intended target. The term "projectile" in this case is construed to reference an object that can be propelled, fired and/or launched in any conventionally understood manner.

Therefore, in addition to rapid detection and data processing of a threat, which the above systems generally provide, the key to achieving an effective projectile defense system is a system that aims and fires countermeasures very quickly. For example, a typical RPG attack occurring from a range of about 50 meters allows less than one-half second between the time the RPG is fired until it strikes its target. From this it may be seen that extremely rapid aiming and firing of countermeasures is a key and primary inventive step for any missile defense system. Methods common in the art, such as turrets that rotate via ring gears and motors, or fast linear actuators, are incapable of aiming countermeasures in the timeframes outlined above. Moreover, vehicles and aircraft require defensive coverage throughout a full 360-degrees of azimuth as well as some degree of elevation. Size, weight, systemic, and cost constraints will optimally require this coverage from a single launcher system. Finally, RPG or other types of missile attacks may occur simultaneously, from different directions and/or different elevations. Existing turret-type defensive launcher systems, no matter how fast acting, can not aim at two different targets simultaneously. U.S. Pat. No. 7,190,304 to Carlson, "System for Interception and Defeat of Rocket Propelled Grenades and Method of Use," describes a combined IR and radar RPG detection system for tactical vehicles and a means for deploying one or more countermeasures, but fails to address the above aiming requirements. Carlson discloses methods of minor course corrections for the countermeasures, but it is not likely that these methods will compensate for large aiming discrepancies. Moreover, steerable countermeasures are much more expensive and complex than countermeasures that are essentially of the point-and-shoot type. Lastly, countermeasures, relying on maneuvering will exclude some types of simple countermeasures that have been demonstrated to be effective against RPGs, such as pellet-type defensive countermeasures. U.S. Pat. No. 7,202,809 to Schade, et al., "Fast Acting Active Protection System" discloses a multi-barrel recoilless gun as the means for aiming and launching countermeasures. Schade, however does not teach how such a gun system is able to physically aim countermeasures in the extremely short timeframe described above. Moreover the system in Schade cannot engage multiple threats simultaneously or nearly simultaneously.

Several complete RPG defense systems have been proposed or are in development. Sometimes referred to as Active Protection Systems (APS), these systems generally use either an explosive kill missile or a 360-degree hail of shot pellets to defeat RPGs. While these systems can be effective, there is serious concern for collateral damage with the use of such systems. Ideally, a defensive system that deploys non-explosive countermeasures to defeat RPG's will greatly reduce the potential for unintended harm to innocent bystanders as well as friendly forces and their assets. Moreover, explosions and hails of pellets are inconsistent with the needs of an RPG defense system that is intended for aircraft deployment. An aircraft-suitable system needs to utilize a carefully-directed countermeasure to avoid damage to itself and other aircraft or dismounted troops in the vicinity. Other deficiencies in existing systems include the inability to engage multiple targets simultaneously and/or in rapid succession, and in some cases the need to reload and service the system after only a single attack. While the technology for detecting RPG attacks appears to be a reality, methods for safely and effectively delivering defensive countermeasures are largely unknown.

There is, therefore, a need for an improved RPG countermeasure delivery system for use in conjunction with available and future detection and warning systems. The system should be capable of delivering non-fratricidal RPG countermeasures, or delivering other countermeasure types in a precisely aimed manner. The system should be adaptable to ground vehicles as well as aircraft, and should be capable of engaging multiple threats simultaneously from different directions and elevations.

SUMMARY OF THE INVENTION

One object of the present invention is to provide an aiming and firing system that covers 360 degrees of azimuth and a substantial elevation coverage while providing very fast aiming throughout this range of coverage.

Another object of the invention is to provide a system that may be deployed in several defensive situations, such as ground vehicles, aircraft, and fixed emplacements.

A further object of the present invention is scalability and the option to adapt the basic platform to various sizes and counter munitions. This is achieved through the simplicity of the mechanical design and the fact that the control scheme is the same regardless of the type of munitions employed.

The present invention provides many advantages over existing munitions launch systems. One advantage is the ability to aim and fire a defensive munitions on a millisecond time scale, thus enabling systems for defense against RPG attack. A further advantage is the ability to deliver multiple individual countermeasures into the pathway of an approaching missile, thus increasing countermeasure effectiveness and defeat probability. This advantage is key to the use of a non-fratricidal flexible-barrier type countermeasure.

Another advantage of the present invention is the ability to provide defensive coverage through 360 degrees while using a single installed unit while maintaining the requisite aiming and firing speed.

Another advantage of the system is the ability to deploy new types of barrier countermeasures such as rocket-towed barriers (RTB's).

Another advantage of the present invention is the ability to deploy existing munitions in a safer manner that reduces fratricidal effects. An example being the deployment of pellet-type (shotgun) RPG countermeasures that are typically fired outward in all directions. Relying on the current system, such counter measures, can be aimed and fired directionally, thus protecting persons and objects not directly in the line with the countermeasure.

Another advantage of the present invention is the ability to defend against simultaneous attack from different directions. The disclosed system can fire countermeasures simultaneously in multiple directions because it effectively has several barrels pointing everywhere at once. A further advantage of such a configuration, is the ability to engage multiple simultaneous attacks occurring at different elevations, such as in the case of simultaneous attack of a ground vehicle from the street level as well as from a rooftop. Such an advantage is accomplished by utilizing a two-tiered rotating array system in which the lower tier is elevated at street level, while the upper tier is elevated to point at the roof.

Yet another advantage of the invention is the ability to defend against multiple attacks without requiring reloading. Assuming a system carrying 16 individual countermeasures, and further assuming that a single RPG attack requires 4 countermeasures to achieve a certainty of defeat; the system is capable of repelling 4 separate attacks before it requires reloading.

Another advantage of the present invention is the option of arming some or all of its launchers or launch tubes with RPG's, thereby providing the capability to deliver return fire. Alternately, other types of weapons, such as guns or cannons may be mounted or interspersed with the countermunitions launch tubes Other systems, methods, features, and advantages of the invention will become apparent to one with skill in the art upon examination of the following figures and detailed description. It is intended that all such systems, methods, features, and advantages be included within this description, be within the scope of the invention, and be protected by the accompanying claims.

BRIEF DESCRIPTION OF THE DRAWINGS

The invention is further described in the accompanying drawings. Components in the figures are not necessarily to scale, emphasis instead being placed upon illustrating the principles of the invention.

DETAILED DESCRIPTION

Figure 1:
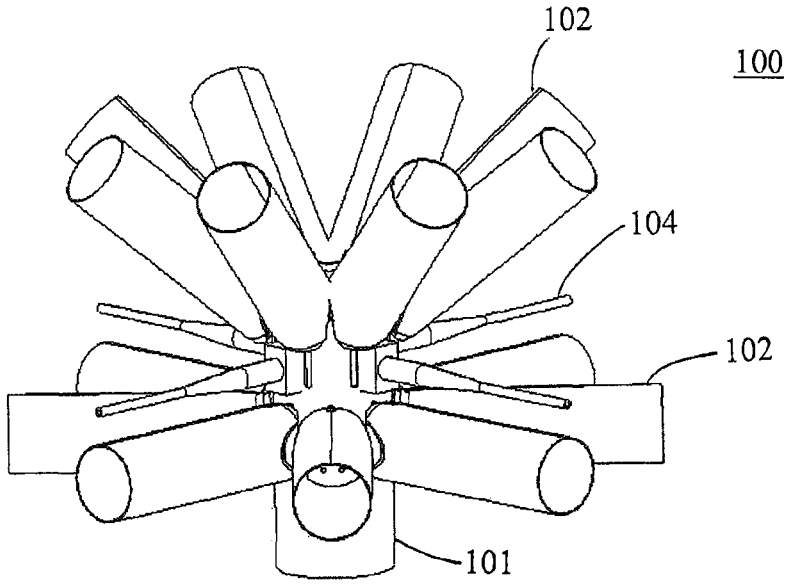
FIG. 1 is a perspective view of an embodiment the system of the present invention.

The invention addresses the above need by providing a rapid aiming and launch system that can fire a variety of countermeasures (CMs). In one exemplary embodiment, the system comprises an array of launchers or launch tubes radially affixed to a central hub. Each launcher or launch tube may carry a countermeasure, which can be one of several types. The central hub rotates on a mounting base, allowing any launcher to be directed at any point on a 360 degree azimuth. The system controls rotation via a motor and an encoder tracks the angular position of the launchers. Individual launchers or launch tubes are supported by brackets with a pivot that allows adjustment in elevation. The launchers or launch tubes are ideally connected via a slew ring arrangement to an actuator that controls the elevation of the launchers and is also under system control via linear encoder. The exemplary system may carry more than one array of launchers in a tiered arrangement. All tiers may be affixed to the common rotational hub and rotate together. Alternatively, each tier may rotate at a different rotational speed. Further, each tier is independently adjustable in elevation via its own slew ring and actuator. Slew rings may be arranged centrally in the hub and may be individually connected via concentric tubes. Firing signals to the countermeasures in the launchers or launch tubes may be conveyed to the rotating assembly via slip ring or inductive coupling within the hub.

The exemplary system receives data from a separate threat warning system such as one outlined above. The data would minimally consist of the approach direction (azimuth) and elevation of an approaching threat, such as a RPG or other ballistic projectile. The exemplary system compares the threat approach vector with the angular location of the countermeasure array, and selects the appropriate the individual countermeasure array element (launchers or launch tube) for firing. The angular location of array elements is available via the rotary encoder affixed to the rotating array structure. The exemplary system then rotates the array, via a motor, to bring a CM element onto the desired firing vector and simultaneously adjusts the CM array, via linear actuator, to the correct intercept elevation. The CM is fired and the system may rotate the next CM element into firing position if more countermeasures are required.

An exemplary method consists of operating the system with the hub and radial countermeasure arrays in continuous rotation. In this embodiment, the need to start and stop the rotation during aiming is eliminated, thereby significantly speeding up the process, and allowing for an extremely rapid fire defensive response. Such quick response is a key requirement for defense against close-range RPG attack, where the total time from weapon launch to target contact may be less than one-half second. Because of the limited response window, aiming needs to be almost instantaneous. As will be noted by those skilled in the art, the exemplary method also allows for the simultaneous engagement of multiple attacks from different directions within the same, or differing, time constraints.

Further, in continuous rotation mode the exemplary system receives threat approach data as indicated by one of the systems above. The CM arrays rotates continuously at a known angular rate of speed. The instantaneous angular position of the rotating array elements (launchers or launch tubes) are know to the system via encoder, as is the slew rate (rate of angular travel). Further, the time required for a particular CM to launch and accelerate onto a desired travel vector is also a known parameter of the system. Upon detection and receipt of a threat signal the exemplary system will select the particular array element, i.e., launch tube, that can be brought to fire on the desired intercept heading in the shortest time. This element is the one that is nearest to the correct firing angle, but still having enough angular travel remaining to allow for the short time interval required for all firing system latencies, such as propellant ignition. The embodied system computes the exact firing point, allowing for latencies, such that the CM will depart on the desired intercept heading as the array rotates through that heading. The firing of additional CMs for this intercept heading is simply a matter of repeating the process for CMs behind the first one that was firing.

A typical example will further illustrate the operation and advantages of the invention. In the case of a system employing rocket-towed barrier (RTB) countermeasures, a typical CM array may have 8 countermeasures arranged at 45 degree intervals radially around the plane of revolution. A system may have two or more such arrays arranged in tiers. The non-fratricidal RTB countermeasure is separately described in U.S. patent application Ser. No. 11/030,649 to Glasson, and is incorporated herein by reference. The countermeasure arrays rotate continuously at a fixed speed around their mounting axis. A rotary encoder tracks the angular position of the array, and thus the exact pointing vector of every CM on the array is continuously available to the system's aiming and launch processor. Since there are several equally spaced CMs on the array, the maximum time interval required to bring a CM to bear on any azimuth point is the rotational speed, divided by the number of CMs in the array. If the array rotates at 60 revolutions per minute and there are 8 CMs arranged radially; the maximum aiming latency for any point in the circle would be ⅛ seconds, or 125 milliseconds. This aiming latency is referred to as the segment delay. The embodied system could be optimally configured such that the segment delay for the CM in use is matched to the firing latencies for that particular CM type. This may be done by simply adjusting the rotational velocity (up) to shorten or (down) to lengthen the segment delay. In this way the maximum aiming delay can be calibrated to no more than the time it takes for the countermeasure to fire and leave its stowed position. It will be apparent to those skilled in the art that much faster aim and launch speeds are possible with faster-launching countermeasures.

Utilizing the present invention, countermeasure launch latencies can be reduced through the design of fast-igniting propellant configurations, or explosive ejection charges. The exemplary system can deliver a barrier countermeasure into the path of an oncoming RPG within 125 milliseconds of the launch request, and additional barriers every 125 ms thereafter. Or a fill rate of 8 barrier countermeasures per second into the flight path of an approaching threat. In this mode the elevation adjustment is made as before, via a slew ring bearing connection in the center of each rotating array. The elevation adjustments are accomplished via fast-acting linear actuators, which are common in the art. Exemplary types include a small-bore hydraulic cylinder powered by an accumulator and controlled by servo valves, a lead screw electric actuator suitably configured for fast operation, or optimally, a double-acting solenoid actuator. Since any elevation adjustments will be small, the use of a short range actuator is enabled. This in turn enables the use of simple actuators that are capable of meeting the speed demands of an RPG defense system. Typical double-acting solenoids are capable of 100 Hz actuation rates and have only one moving part.

In the following drawings like numbers are used to depict like elements of the various drawings. FIG. 1 shows an exemplary embodiment of a system in accordance with the present invention. System 100 discloses rotating hub 101, launchers 102, and guns 104. As depicted in FIG. 1 launchers 102 are radially arranged about hub 101 in multiple tiers to provide for 360 degrees of countermeasure protection. While system 100 depicts launchers 102 as tubes, it should be appreciated by those skilled in the art that it is not limited to tubes, and that depending on the preferred countermeasures deployed other configurations are possible. For example, launchers 102 may be open rails, brackets, clamps or other countermeasure housings and holding fixtures without departing from the spirit of the invention. Further, guns 104 are not limited to traditional munitions and may be any type of offensive weapon that a user wishes to deploy in response to a detected threat.

Figure 2:
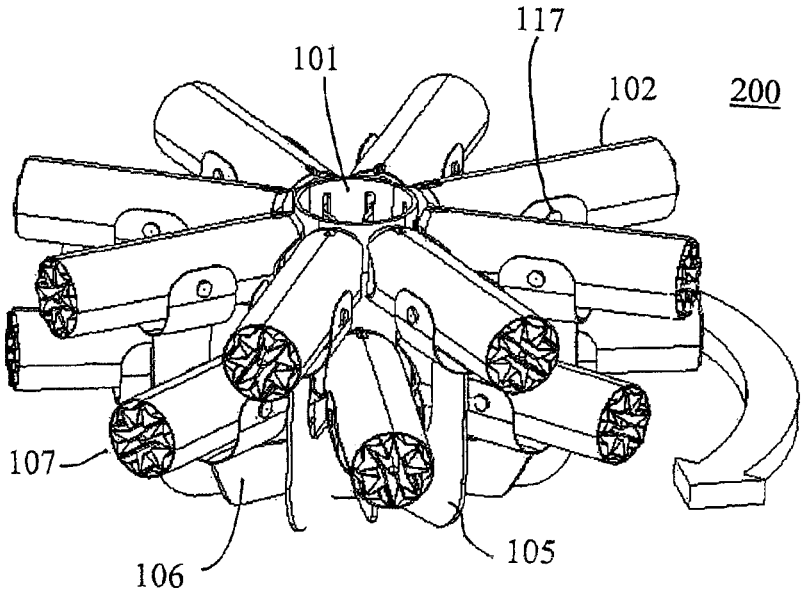
FIG. 2 is a perspective view of an alternate embodiment the system of the present invention.

FIG. 2 shows an alternative embodiment of the present invention. System 200 contains rotating hub 101, launchers 102, upper support arms 105 and lower support arms 106. Although not part of the launch system, a typical countermeasure 107 is shown inserted into launchers 102.

Depending on the specific deployment desired, system 200 may be mounted by rotating hub 101 atop or vehicle, ship or under an aircraft. Additionally, rotating hub 101 provides the mounting means for upper support arms 105 and lower support arms 106. Upper support arms 105 and lower support arms 106 provide support and a mounting point for launchers 102. Launchers 102 are pivotally mounted at pivot 117 in the support arms 105 and 106, providing elevation adjustment with respect to the plane of rotation of rotating hub 101. In operation, rotating hub 101 provides 360 degree countermeasure coverage, while pivotally mounted launchers 102 provide elevated coverage.

Figure 3:
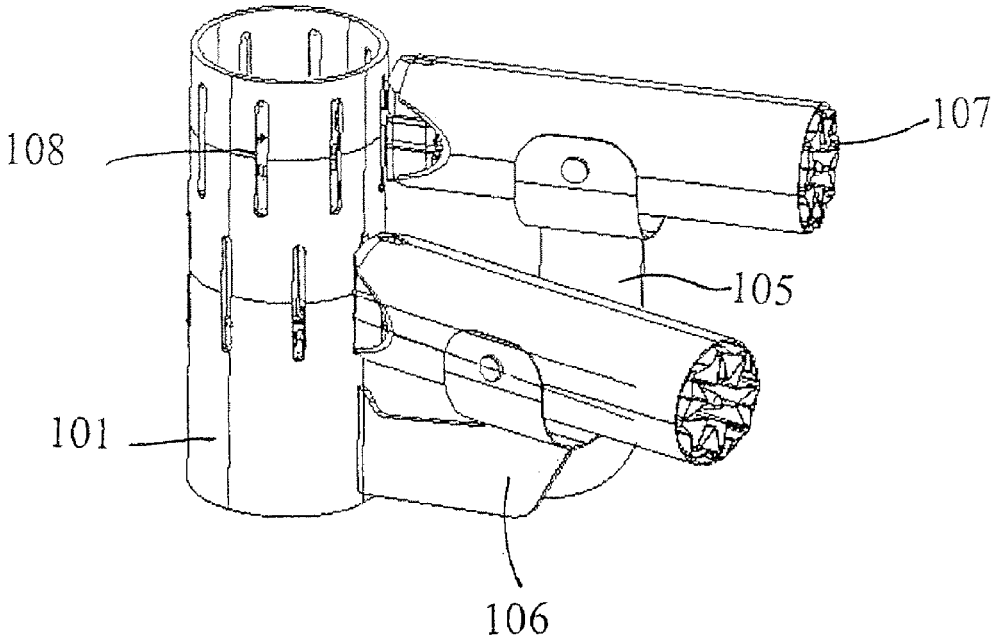
FIG. 3 is a perspective view of a mounting and launcher partial assembly in accordance with an embodiment of the present invention.
Figure 4:
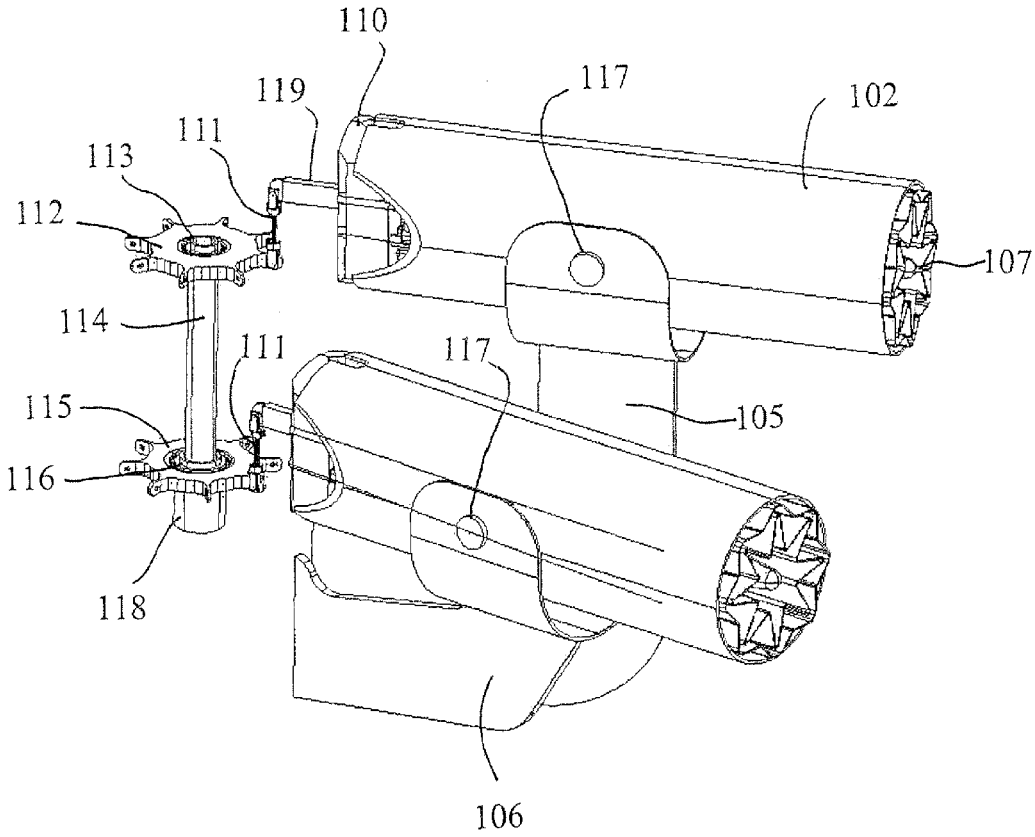
FIG. 4 is a perspective view of a launcher tube and elevation adjusting partial assembly in accordance with an embodiment of the present invention.

FIGS. 3 and 4 depict a partial assembly of a hub 101, launchers 102, and elevation adjusting means as shown. FIG. 3 shows upper support arms 105 and lower support arm 106 fixed to hub 101 and providing support for the two levels of tubes 102. Upper slot 108 in hub 101 provides an aperture for elevation adjustment arm 119 as shown in FIG. 4. FIG. 4 depicts the assembly with hub 101 removed for ease of viewing. FIG. 4 depicts an exemplary embodiment of the apparatus for adjusting elevation while allowing rotation of hub 101 and launchers 102. FIG. 4 discloses tube 102, plate 110, link 111, slew ring 112, arm 119, and tube 114 passing through the inner race of bearing 116 and extending through and fixed to the inner race of bearing 113. Also depicted are slew ring 115, bearing 116 pressed into the center bore of slew ring 115, and tube 118 extending through and fixed to the inner race of bearing 116.

Each tube 102 is closed at the back end by plate 110. Plate 110 has an arm 119 extending backwards to provide a connection to the elevation adjusting parts. Link 111 connects arm 119 to slew ring 112, in the upper portion and to slew ring 115 in the lower portion of FIG. 4.

The slew rings 112 and 115 have different inner diameters to allow for multiple slew rings on a single axis. Each slew ring has a bearing pressed into its center bore. Bearing 113 in the upper slew ring 112 has a smaller inner diameter than bearing 116, which is pressed into the center bore of slew ring 115. A larger tube 118 extends through and is fixed to, the inner race of bearing 116. A smaller tube 114 passes through the inner race of bearing 116 then extends through and is fixed to, the inner race of bearing 113. The slew rings, bearings, and tubes are preferably located along the axis of hub 101. Movement of tube, 114 or 118, with respect to the vertical direction of FIG. 4, results in pivoting motion of tubes 102 around a pivot 117 in lower support 105 and upper support 106 and provides aiming adjustment of the defensive system.

Figure 5:
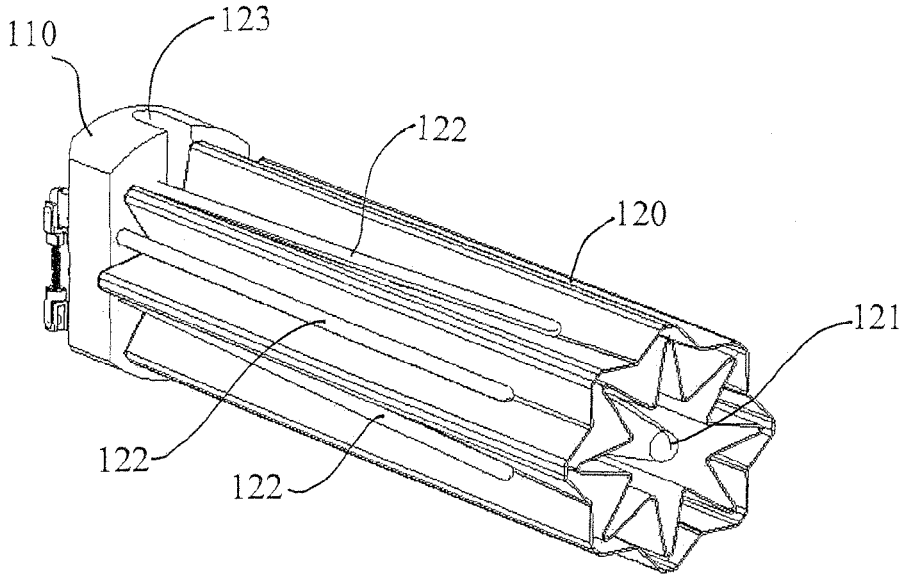
FIG. 5 is a perspective view of a single rocket-towed countermeasure in stowed condition in accordance with an embodiment of the present invention.

FIG. 5 depicts an exemplary a rocket-towed barrier countermunition. An exemplary countermunition is shown in the stowed position as it would reside within tube 102. Tube 102 is removed from FIG. 5 for clarity. The barrier 120 is shown folded and doubled with a tow rocket 121 nested in the center of the barrier. Guide rods 122 provide nesting and uniform stowage to the rocket-towed barrier 120 within tube 102, and help to guide the barrier out of tube 102 during launch. Plate 110 is provided with a sprue 123 to direct rocket exhaust gases upward.

Figure 6:
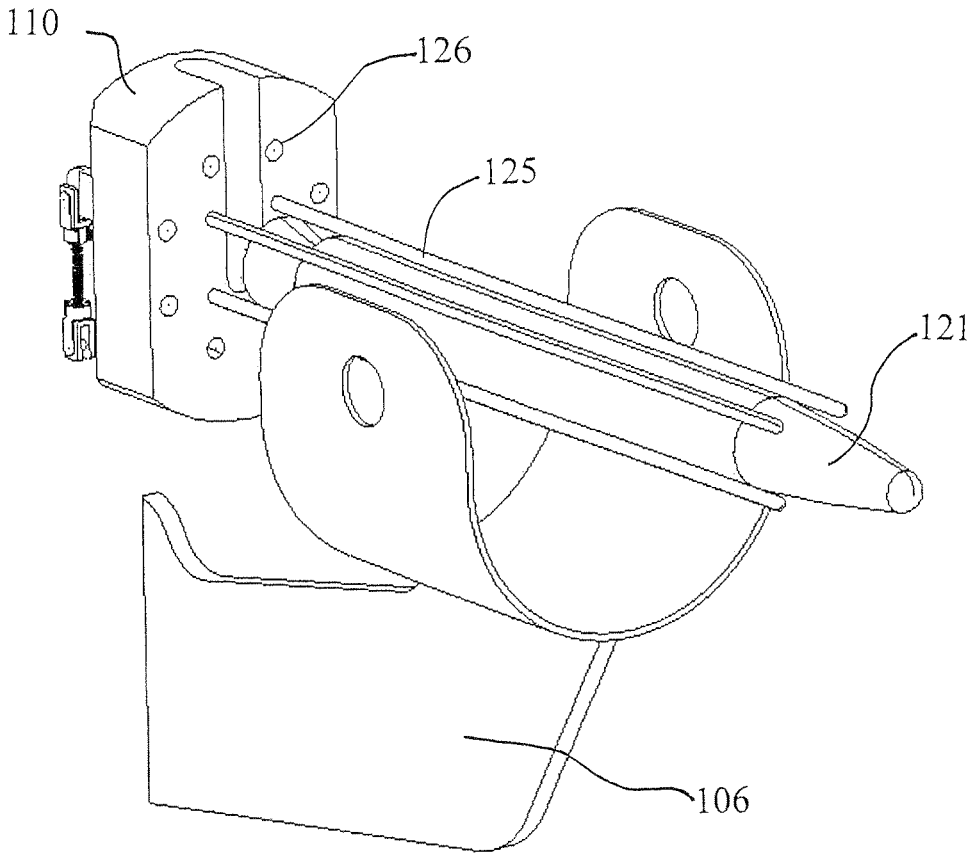
FIG. 6 is a perspective view of a single tow rocket and launch carrier in accordance with an embodiment of the present invention.

FIG. 6 depicts an exemplary tow rocket 121 in the stowed position within a launch tube 102. Tube 102 has been removed for reasons of clarity. Guide rods 125 hold the rocket in a proper orientation and provide guidance as it is launched. Plate 110 is provided with holes 126 to facilitate the mounting of guide rods 125 and 122. As will be appreciated by those skilled in the art, other munitions and countermeasures, and other mounting and launching configurations, may be utilized without departing from the spirit of the invention.

Figure 7:
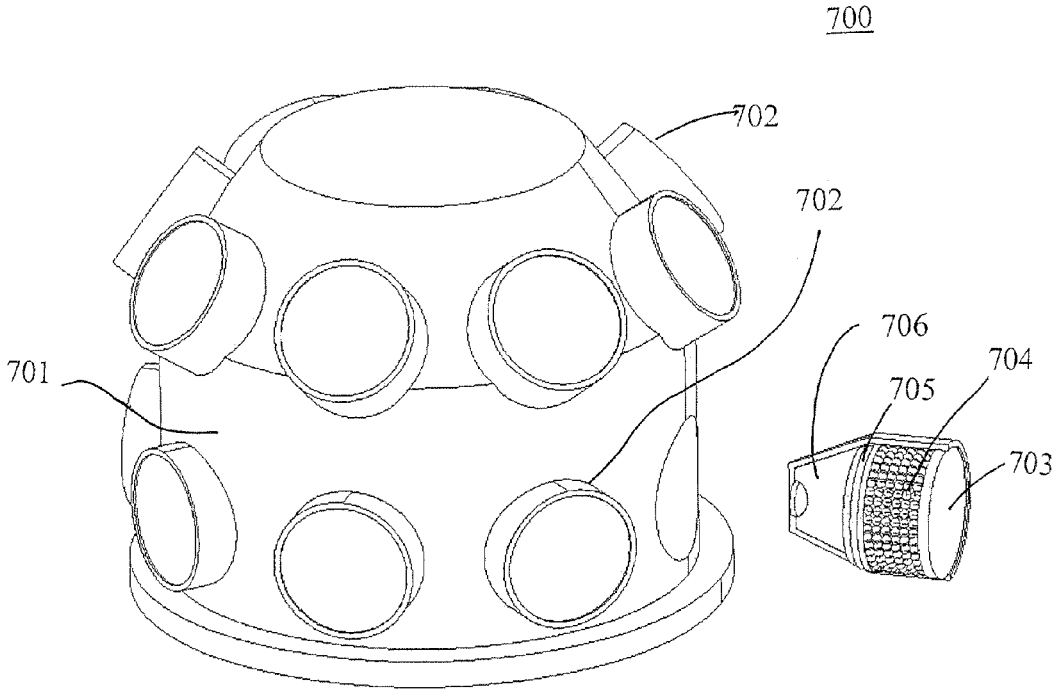
FIG. 7 is an alternative embodiment of the invention that provides for a smaller more compact size.

FIG. 7 discloses an alternative embodiment of the present invention. System 700 contains launch array 701, containing sixteen launch tubes 702 arranged in two tiers. Each launch tube 702 contains a cap 703, pellets 704, wadding 705, and an explosive charge 706. An exemplary launch tube 702 is shown away from the assembly.

In this compact embodiment, pellet countermeasures 704 are dispensed in a highly directed way and consecutive shots from multiple launch tubes 702 may be deployed thereby increasing the efficiency of the countermeasure while decreasing the probability of causing collateral damage. In operation system 700 after detecting a threat and determining the proper launcher 702 to respond to the threat, positions the proper launcher 702, and launches pellets 704 in the general vicinity of the threat by igniting explosive charge 706 behind wadding 705, thereby causing pellets 704 to launch from the tube 702 in the area of the threat.

While FIG. 7 is depicted with sixteen launch tubes 702 in two tiers, it will be appreciated by those skilled in the art that different numbers of launch tubes and different geometries are possible without departing from the nature of the invention. Further as will also be appreciated, system 700 may be deployed with or without elevation adjustment and may utilize other types of munitions and is not limited to pellet-type countermeasures.

A system and method for rapid aiming and firing of weapons and defensive countermeasures in accordance with the present invention provides defensive coverage for vehicles, ships, and aircraft and mounts a variety of weapons or countermeasures in outwardly-facing arrays. The system rotates continuously and a high speed processor receives data from a threat warning system and selectively fires a weapon or countermeasure in response to an attack.

Those skilled in the art will readily recognize numerous adaptations and modifications which can be made to system and method for rapid aiming and firing of weapons and defensive countermeasures of the present invention which will result in an improved system, yet all of which will fall within the scope and spirit of the present invention as defined in the following claims. Accordingly, the invention is to be limited only by the following claims and their equivalents.

What is claimed is:

1. A system for launching projectiles comprising:

a launch platform having a rotational axis, the launch platform containing a first plurality of projectile launchers arranged in a first tier and a second plurality of projectile launchers arranged in a second tier, the first and second tiers of projectile launchers being radially distributed around a hub that is rotatable about the rotational axis, wherein launchers in one or more of the first plurality of launchers and the second plurality of launchers are pivotable about pivot axes perpendicular to the rotational axis of the launch platform for adjusting elevations of the pivotable launchers.

2. The system of claim 1 wherein the first and second tiers of projectile launchers are configured to rotate at a continuous rotational velocity.

3. The system of claim 1 wherein the first and second tiers of projectile launchers are configured to rotate 360 degrees about the rotational axis of the launch platform.

4. The system of claim 1 wherein the launch platform is configured to simultaneously launch ones of first and second pluralities of projectiles from respective launchers in the first and second pluralities of projectile launchers.

5. The system of claim 4, further comprising:

first and second actuators configured to respectively and adjustably pivot the first plurality of projectile launchers and the second plurality of projectile launchers, wherein the projectile launchers in the first and second pluralities of projectile launchers are capable of launching projectiles at different azimuths and elevations.

6. The system of claim 1, wherein launchers in one or more of the first plurality of projectile launchers and the second plurality of projectile launchers have a type selected from the group consisting of tubes, open rails, brackets and clamps.

7. The system of claim 1, further comprising a plurality of guns arranged in a third tier positioned between the first and second pluralities of projectile launchers.

8. The system of claim 1, further comprising first and second pluralities of projectiles respectively maintained by the first and second pluralities of projectile launchers.

9. The system of claim 8, wherein the first and second pluralities of projectiles comprise countermeasures.

10. The system of claim 9, wherein the countermeasures comprise pellet-type countermeasures.

11. The system of claim 9, wherein the countermeasures comprise rocket-towed barrier-type countermeasures.

12. The system of claim 11, wherein each of the projectile launchers comprises a launch tube coupled to a rear plate having a sprue channel for directing exhaust gases of a corresponding rocket-towed barrier-type countermeasure away from the launch platform.

13. The system of claim 1, wherein the launch platform is further coupled to a motor for rotating the launch platform.

14. A method of launching a projectile comprising the steps of:

receiving threat information comprising an azimuth and an elevation of an approaching threat;

providing a launch platform having a rotational axis, said launch platform containing a first plurality of launchers arranged in a first tier for maintaining a first plurality of projectiles, and a second plurality of launchers arranged in a second tier for maintaining a second plurality of projectiles, wherein the first and second tiers of projectile launchers are rotatable about the rotational axis and launchers in one or more of the first plurality of launchers and the second plurality of launchers are pivotable about pivot axes perpendicular to the rotational axis of the launch platform for adjusting elevations of the pivotable launchers;

determining an angular position of the launch platform; and selecting a launcher from one of the first plurality of launchers or the second plurality of launchers as a function of the angular position of the launch platform and the received threat information.

15. The method of claim 14, further comprising the steps of:

determining a launch position of the launcher as a function of the received threat information;

rotating and pivoting the launcher into the launch position; and firing the projectile.

16. The method of claim 15, wherein said rotating step comprises the step of rotating the launch platform continuously during at least each of the determining, selecting, pivoting and firing steps.

17. A projectile launch array for launching first and second pluralities of projectiles, the array comprising:

a launch platform having a rotational axis, the launch platform containing a first plurality of launchers arranged in a first tier for maintaining the first plurality of projectiles and a second plurality of launchers arranged in a second tier for maintaining the second plurality of projectiles, wherein the first and second pluralities of launchers are configured to launch the first and second pluralities of projectiles simultaneously at respective first and second launch elevations, wherein a first launcher angle defining the first launch elevation is different from a second launcher angle defining the second launch elevation, and wherein each of the first and second pluralities of launchers comprises a plurality of launch tubes radially arrayed around the rotational axis through 360 degrees of azimuth at substantially equi-angular spacings.

18. The array of claim 17, wherein each of the pluralities of launch tubes is arranged as an array of sixteen launch tubes radially arrayed about the launch platform.

19. The array of claim 17, further comprising:

the first and second pluralities of projectiles, wherein the first and second pluralities of projectiles comprise countermeasures.

20. The array of claim 19, wherein the countermeasures comprise pellet-type countermeasures.

21. The array of claim 19, wherein the countermeasures comprise rocket-towed barrier-type countermeasures.

* * * * *